US008075155B2

(12) United States Patent
Watanabe et al.

(10) Patent No.: US 8,075,155 B2
(45) Date of Patent: Dec. 13, 2011

(54) ELECTRIC POWER TOOL

(75) Inventors: Masahiro Watanabe, Anjo (JP); Jiro Suzuki, Anjo (JP); Takuya Kusakawa, Anjo (JP)

(73) Assignee: Makita Corporation, Anjo-Shi (JP)

( * ) Notice: Subject to any disclaimer, the term of this patent is extended or adjusted under 35 U.S.C. 154(b) by 573 days.

(21) Appl. No.: 12/289,787

(22) Filed: Nov. 4, 2008

(65) Prior Publication Data

US 2009/0128062 A1 May 21, 2009

(30) Foreign Application Priority Data

Nov. 16, 2007 (JP) ..... 2007-297498

(51) Int. Cl.
*B25B 23/18* (2006.01)

(52) U.S. Cl. ..... 362/119; 315/33; 315/362; 315/363; 307/126; 307/140; 307/410; 310/50

(58) Field of Classification Search ..... 315/33, 315/362, 363; 362/119; 310/50; 307/126, 307/140, 410

See application file for complete search history.

(56) References Cited

U.S. PATENT DOCUMENTS

| | | | | |
|---|---|---|---|---|
| 3,458,793 | A * | 7/1969 | Tsergas | 388/820 |
| 5,169,225 | A * | 12/1992 | Palm | 362/118 |
| 6,318,874 | B1 * | 11/2001 | Matsunaga | 362/119 |
| 6,511,200 | B2 * | 1/2003 | Matsunaga | 362/119 |
| 6,814,461 | B2 * | 11/2004 | Minalga | 362/119 |
| 7,282,818 | B2 * | 10/2007 | Kovarik | 307/117 |

FOREIGN PATENT DOCUMENTS

| | | |
|---|---|---|
| EP | 1 068 934 A1 | 1/2001 |
| JP | A-2001-25982 | 1/2001 |
| JP | A-2003-326477 | 11/2003 |

* cited by examiner

*Primary Examiner* — Douglas W Owens
*Assistant Examiner* — Thai Pham
(74) *Attorney, Agent, or Firm* — Oliff & Berridge, PLC

(57) ABSTRACT

An electric power tool, which comprises a motor that drives a tool, a power source unit that applies voltage to the motor, a main switching circuit that makes/breaks an electrical connection between the power source unit and the motor, an illuminator that illuminates a work spot, a switching device that electrically connects the illuminator to the power source unit, and an OR circuit that is electrically connected to terminals of the motor to the base terminal is provided. The OR circuit electrically connects one of the motor terminals at which a voltage is higher to the base terminal.

8 Claims, 4 Drawing Sheets

ELECTRIC POWER TOOL

CROSS-REFERENCE TO RELATED APPLICATION

This application claims priority to Japanese Patent Application No. 2007-297498, filed on Nov. 16, 2007, the contents of which are hereby incorporated by reference into the present application.

BACKGROUND OF THE INVENTION

1. Field of the Invention

The present invention relates to an electric power tool, and specifically to an electric power tool having an illuminator that illuminates a work spot.

2. Description of the Related Art

U.S. Pat. No. 6,318,874 B1 discloses an electric power tool that comprises a motor for driving a tool, a power source unit (battery) that applies DC voltage to the motor terminals of the motor, a main switching circuit that makes/breaks an electrical connection between the motor terminals and the power source unit, and a forward-reverse switching circuit that switches a direction of the DC voltage which is applied from the power source unit to the motor terminals via the main switching circuit.

In this electric power tool, when the main switching circuit is turned ON, DC voltage is applied to the motor terminals and the DC motor starts driving the tool. When the main switching circuit is turned OFF, the DC voltage application to the motor terminals is suspended and the drive of the DC motor is stopped.

Direction of the DC voltage which is applied to the motor terminals can be switched by the forward-reverse switching circuit, so that the direction to which the tool is driven by the motor is freely switched between the forward and reverse direction.

The electric tool described above further comprises an illuminator that illuminates a work spot where the tool is used, and a switching device for turning ON/OFF the illuminator. The switching device has a base terminal. When a base voltage applied to the base terminal is higher than a threshold level, the switching device electrically connects the illuminator to the power source unit. In other words, light of the illuminator is turned ON. To the base terminal of the switching device, a motor side contact of the main switching circuit is electrically connected. Accordingly, when the main switching circuit is turned ON, a voltage at or higher than a threshold level is applied to the base terminal from the power source unit and the illuminator is turned ON. At the same time, the motor starts driving the tool. When the main switching circuit is turned OFF, the DC voltage application at or higher than a threshold level to the base terminal from the power source unit is suspended, and the illuminator is turned OFF. At the same time, the drive of the tool by the motor is stopped. In this electric power tool, illuminator is turned ON and OFF in conjunction with the starting and stopping of driving the tool by the motor.

BRIEF SUMMARY OF THE INVENTION

Recently, switching modules in which a main switching circuit and a forward-reverse switching circuit are incorporated, and electric power tools in which such switching modules are adopted have been developed. Such switching modules enable simplification of the circuit configuration of the electric power tools, and thereby reducing costs for assembling the tools.

However, the switching modules involve difficulty in leading out a signal line from the motor side contact of the main switching circuit, since the main switching circuit is incorporated therein. Accordingly, if the switching module of this type is adopted in the aforementioned electric power tool, it becomes impossible to make an electrical connection between the illuminator and the motor side contact of the main switching circuit. In other words, the circuit configuration as in the electric power tools as described above cannot adopt the switching module of this type.

In cases where it is impossible to lead out a signal line from the motor side contact of the main switching circuit, the base terminal of the switching device may be electrically connected to one of the motor terminals. This circuit configuration would appear to be capable of turning the illuminator ON/OFF in conjunction with starting/stopping driving the tool by the motor. However, when the direction of the DC voltage which is applied to the motor terminals is reversed by the forward-reverse switching circuit, the base voltage then becomes incapable of turning ON the illuminator. Of course, both of the motor terminals can not be simply connected to the base terminal, which causes short circuit of the motor terminals.

The teachings of the present invention solve the problem. According to the present invention, a technique for turning ON/OFF in conjunction with starting/stopping driving the tool by the motor, without using the motor side contact of the main switching circuit is provided.

In an electric power tool of the present teachings, motor terminals of a motor are electrically connected to a base terminal of a switching device for an illuminator via an OR circuit. The OR circuit can electrically connect one of the motor terminals whose voltage is higher than the other motor terminal to the base terminal. Therefore, even when the direction of voltage that is applied to the motor terminals is altered, enough voltage to turn ON the switching device is applied to the base terminal in either direction. This configuration enables turning ON/OFF the illuminator in conjunction with starting/stopping driving the tool by the motor, regardless of the direction of the voltage which is applied to the motor terminals.

In this electric power tool, the base terminal of the switching element does not have to be electrically connected to a motor side contact of a main switching circuit. Accordingly, a switching module in which the main switching circuit is incorporated can be advantageously adopted, in order to reduce costs for assembling the electric power tool.

Preferably, the OR circuit comprises a first rectifying device that is electrically connected between the first motor terminal and the base terminal. Furthermore, the first rectifying device forbids current flowing from the base terminal to the first motor terminal. Moreover, the OR circuit further comprises a second rectifying device that is electrically connected between the second motor terminal and the base terminal. The second rectifying device forbids current flowing from the base terminal to the second motor terminal.

Preferably, the electric power tool further comprises a capacitor that is electrically connected to the base terminal of the switching device.

This configuration and the employment of the capacitor enables prolonged voltage application to the base terminal even after the main switching circuit is turned OFF, in order to keep the light of the illuminator to be in ON state for a predetermined period.

DETAILED DESCRIPTION OF THE INVENTION

Preferred Features of an Embodiment of the Invention

Some of the preferred features of an embodiment of the invention are described in the followings.

(Feature 1) In a switching device, transistors such as NPN transistors or field-effect transistors are preferably used.

(Feature 2) In rectifying devices, diodes are preferably used.

(Feature 3) A main switching circuit and a forward-reverse switching circuit are preferably integrally configured as a switching module.

(Feature 4) A capacitor is connected to a base terminal of a switching device and an emitter terminal.

Embodiment of the Invention

An electric power screw driver according to the invention is described with reference to the attached drawings. An electric power screw driver is one of electric power tools, which is used for screwing. The embodiment according to the invention adopts an electric power screw driver using impact method (electric power impact screw driver). It should be noted that the embodiment of the present invention is not limited to the application as hereinbelow exemplified.

Figure 1:
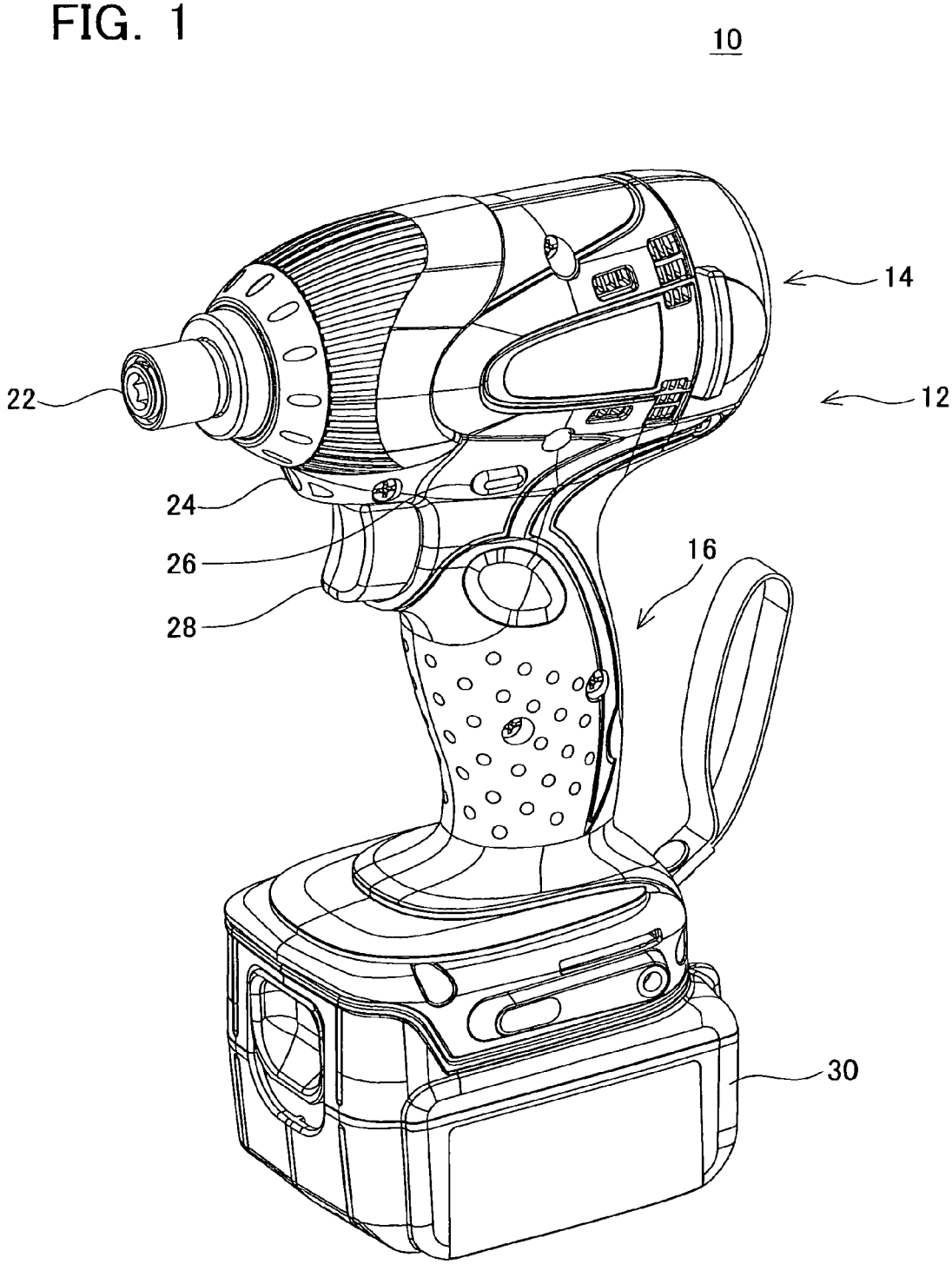
FIG. 1 shows a perspective view of the electric power screw driver.
Figure 2:
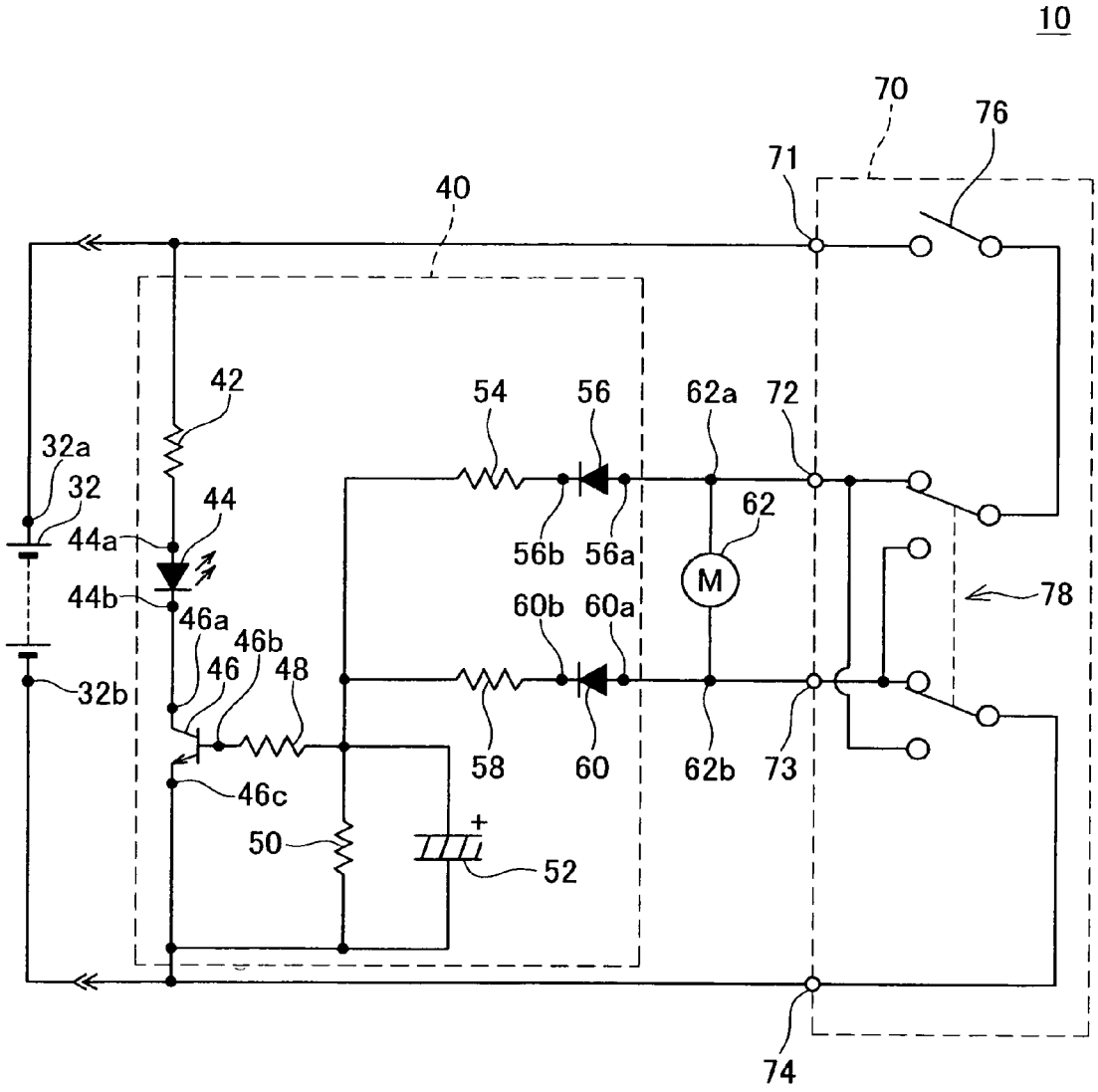
FIG. 2 shows an electrical configuration of the electric power screw driver.

FIG. 1 shows a perspective view of the appearance of an electric power screw driver 10. FIG. 2 shows an electrical circuit configuration of the electric power screw driver 10. As shown in the FIG. 1, the electric power screw driver 10 comprises a main body 12 and a battery pack 30 detachably installed to the main body 12. The main body 12 generally comprises a chassis 14 having an approximate cylindrical shape and a grip 16 extending downward from the chassis 14. The battery pack 30 is installed at a lower end of the grip 16. The battery pack 30 incorporates a secondary battery 32 (refer to FIG. 2), which allows repeated use by recharging.

The chassis 14 of the main body 12 has a tool chuck 22. The tool chuck 22 is rotatably retained at a distal end (left end in FIG. 1) of the chassis 14. To the tool chuck 22, tool bits such as a driver bit or a drill bit (both not shown) can be attached. The tool chuck 22 is driven by a motor 62 incorporated in the chassis 14 (refer to FIG. 2).

The chassis 14 of the main body 12 has a light emitting part 24. The light emitting part 24 is placed below the tool chuck 22. The light emitting part 24 incorporates light-emitting diode 44 (refer to FIG. 2) that emits illumination light. The light emitting part 24 emits light toward front of the tool chuck 22. Light of the light emitting part 24 is turned ON/OFF in conjunction with the operation to a trigger switch 28 described below.

The chassis 14 of the main body 12 has a forward-reverse switching button 26. The forward-reverse switching button 26 is operated by a user. By the user's operation of the forward-reverse switching button 26, the rotating direction of the tool chuck 22 is caused to switch either forward or reverse. The forward-reverse switching button 26 is coupled to a forward-reverse switching circuit 78 of a switching module 70 incorporated in the main body 12 (refer to FIG. 2). When the forward-reverse switching button 26 is operated by the user, the forward-reverse switching circuit 78 of the switching module 70 is switched.

The grip 16 of the main body 12 has the trigger switch 28. The trigger switch 28 is operated by the user in order to start or stop rotation of the tool chuck 22. The trigger switch 28 is coupled to a main switching circuit 76 of the switching module 70 incorporated in the main body 12 (refer to FIG. 2). By the user's operation to the trigger switch 28, the main switching circuit 76 of the switching module 70 is caused to open or close.

With reference to FIG. 2, the electrical configuration of the electric power screw driver is described. As shown in FIG. 2, the electric power screw driver 10 has a motor 62, a secondary battery 32, a switching module 70, and an illumination circuit 40. The motor 62 is DC motor for driving the tool chuck 22. The secondary battery 32 is incorporated in the battery pack 30, which supplies DC electric power to the motor 62. The output voltage of the battery pack 30 is approximately 12V.

The switching module 70 has a first input terminal 71, a second input terminal 74, a first output terminal 72, and a second output terminal 73. The first input terminal 71 is connected to a positive electrode 32*a* of the secondary battery 32. A second input terminal 74 is connected to a negative electrode 32*b* of the secondary battery 32. The first output terminal 72 is connected to the first motor terminal 62*a* of the motor 62. The second output terminal 73 is connected to the second motor terminal 62*b* of the motor 62.

Inside the switching module 70, equipped therein are the main switching circuit 76 which works in conjunction with the trigger switch 28 (refer to FIG. 1), and the forward-reverse switching circuit 78 which works in conjunction with the forward-reverse switching button 26. The main switching circuit 76 that makes and breaks an electrical connection between the secondary battery 32 and the motor 62 is provided between the first input terminal 71 and the forward-reverse switching circuit 78.

The forward-reverse switching circuit 78 is provided between the first input terminal 71 and the second input terminal 74, and coincidentally to the aforesaid arrangement, also between the first output terminal 72 and the second output terminal 73. The forward-reverse switching circuit 78 switches the direction of DC voltage applied to the first and second motor terminals 62*a*, 62*b* from the secondary battery 32 via the main switching circuit 76. For example, in the case where the forward-reverse switching circuit 78 is switched in one direction (e.g. the state shown in FIG. 2), the positive electrode 32*a* of the secondary battery 32 is connected to the first motor terminal 62*a* via the main switching circuit 76, and the negative electrode 32*b* of the secondary battery 32 is connected to the second motor terminal 62*b*. In this case, DC voltage is applied to the first and second motor terminals 62*a*, 62*b* in the direction from the first motor terminal 62*a* to the second motor terminal 62*b*. In the case where the forward-reverse switching circuit 78 is switched in the other direction while initially being in the state as shown in FIG. 2, the positive electrode 32*a* of the secondary battery 32 is connected to the second motor terminal 62*b* via the main switching circuit 76, and the negative electrode 32*b* of the secondary battery 32 is connected to the first motor terminal 62*a*. In this case, DC voltage is applied to the first and second motor terminals 62*a*, 62*b* in the direction from the second motor terminal 62*b* to the first motor terminal 62*a*. The forward-reverse switching circuit 78 can thus switch the rotating direction of the motor 62, by switching the direction of DC voltage applied from the secondary battery 32 to the first and second motor terminals 62*a*, 62*b*.

The illumination circuit 40 is configured with a light-emitting diode 44, a transistor 46, an electrolytic capacitor 52, a first diode 56, a second diode 60 and a plurality of resistors 42, 46, 48, 50, 54, 58.

The light-emitting diode 44 is placed in the light-emitting part 24 (refer to FIG. 1). The light-emitting diode 44 has an anode 44*a* and a cathode 44*b*, and emits light when current flows from the anode 44*a* to the cathode 44*b*. The light-emitting diode 44 is connected to the secondary battery 32 via the resistor 42 and the transistor 46. As shown in FIG. 2, the anode of the light-emitting diode 44 is electrically connected to the positive electrode 32*a* of the secondary battery 32 via the resistor 42. The cathode of the light-emitting diode 44 is electrically connected to the negative electrode 32*b* of the secondary battery 32.

The transistor 46 is a switching device that makes/breaks an electrical connection between the light-emitting diode 44 and the secondary battery 32. The transistor 46 has a collector terminal 46*a*, a base terminal 46*b* and an emitter terminal 46*c*. The collector terminal 46*a* of the transistor 46 is connected to the positive electrode 32*a* of the secondary battery 32 via the light-emitting diode 44 and the resistor 42. The emitter terminal 46*c* of the transistor 46 is connected to the negative electrode 32*b* of the secondary battery 32. The transistor 46 electrically connects the collector terminal 46*a* to the emitter terminal 46*c* in a case where a base voltage (base-emitter voltage) applied to the base terminal 46*b* becomes higher than a threshold level.

The base terminal 46*b* of the transistor 46 is connected to the first motor terminal 62*a* via the first diode 56. The first diode 56 is a kind of rectifying device. The first diode 56 allows current to flow from its anode 56*a* to its cathode 56*b*, but forbids current to flow from the cathode 56*b* to the anode 56*a*. The anode 56*a* of the first diode 56 is electrically connected to the first motor terminal 62*a*. The cathode 56*b* of the first diode 56 is electrically connected to the base terminal 46*b* of the transistor 46 via the two resistors 48, 54.

Further, the base terminal 46*b* of the transistor 46 is connected to the second motor terminal 62*b* via the second diode 30. Likewise, the second diode 60 is also a kind of rectifying device. The second diode 60 allows current to flow from its anode 60*a* to the cathode 60*b*, but forbids current to flow from the cathode 60*b* to the anode 60*a*. The anode 60*a* of the second diode 60 is electrically connected to the second motor terminal 62*b*. The cathode 60*b* of the second diode 60 is electrically connected to the base terminal 46*b* of the transistor 46 via the two resistors 48, 58.

As described above, the base terminal 46*b* of the transistor 46 is electrically connected to the first motor terminal 62*a* and the second motor terminal 62*b* via the first diode 56 and the second diode 60. The first diode 56 and the second diode 60 configure a type of an OR circuit. The OR circuit 56, 60 electrically connects one of the first and second motor terminals 62*a*, 62*b* having higher voltage to the base terminal 46*b* of the transistor 46.

Further, the electrolytic capacitor 52 is connected to the base terminal 46*b* of the transistor 46 via the resistor 48. The electrolytic capacitor 52 is a type of capacitor. One end of the electrolytic capacitor 52 is electrically connected to the base terminal 46*b* of the transistor 46, and the other end of the electrolytic capacitor 52 is electrically connected to the emitter terminal 46*c* of the transistor 46. Specifically, the base terminal 46*b* and the emitter terminal 46*c* of the transistor 46 are electrically connected to each other via the electrolytic capacitor 52 and the resistor 48. Further, the resistor 50 is connected in parallel to the electrolytic capacitor 52.

Figure 3:
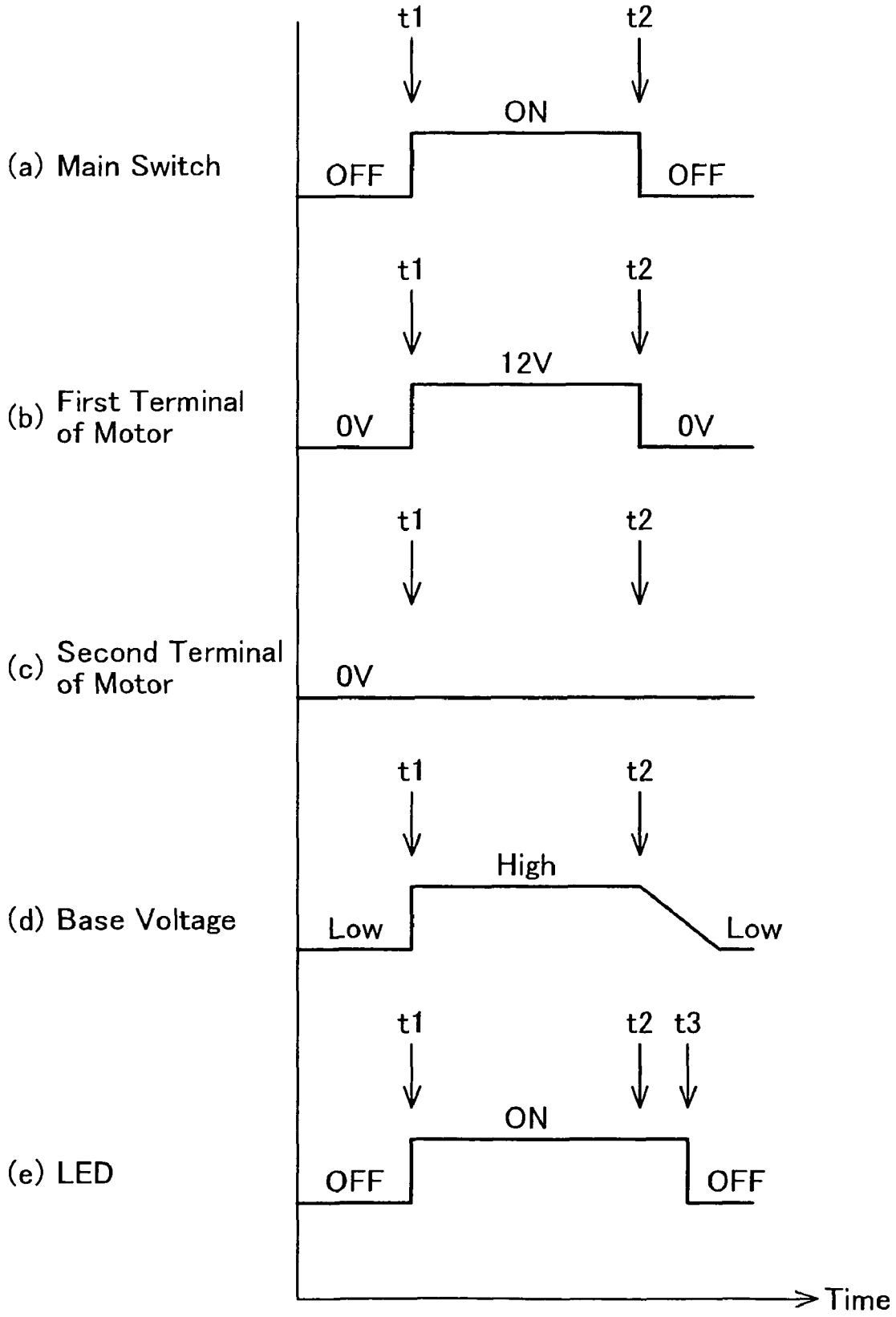
FIG. 3 shows a timing diagram describing operation and condition of principal configuration in forward rotation.
Figure 4:
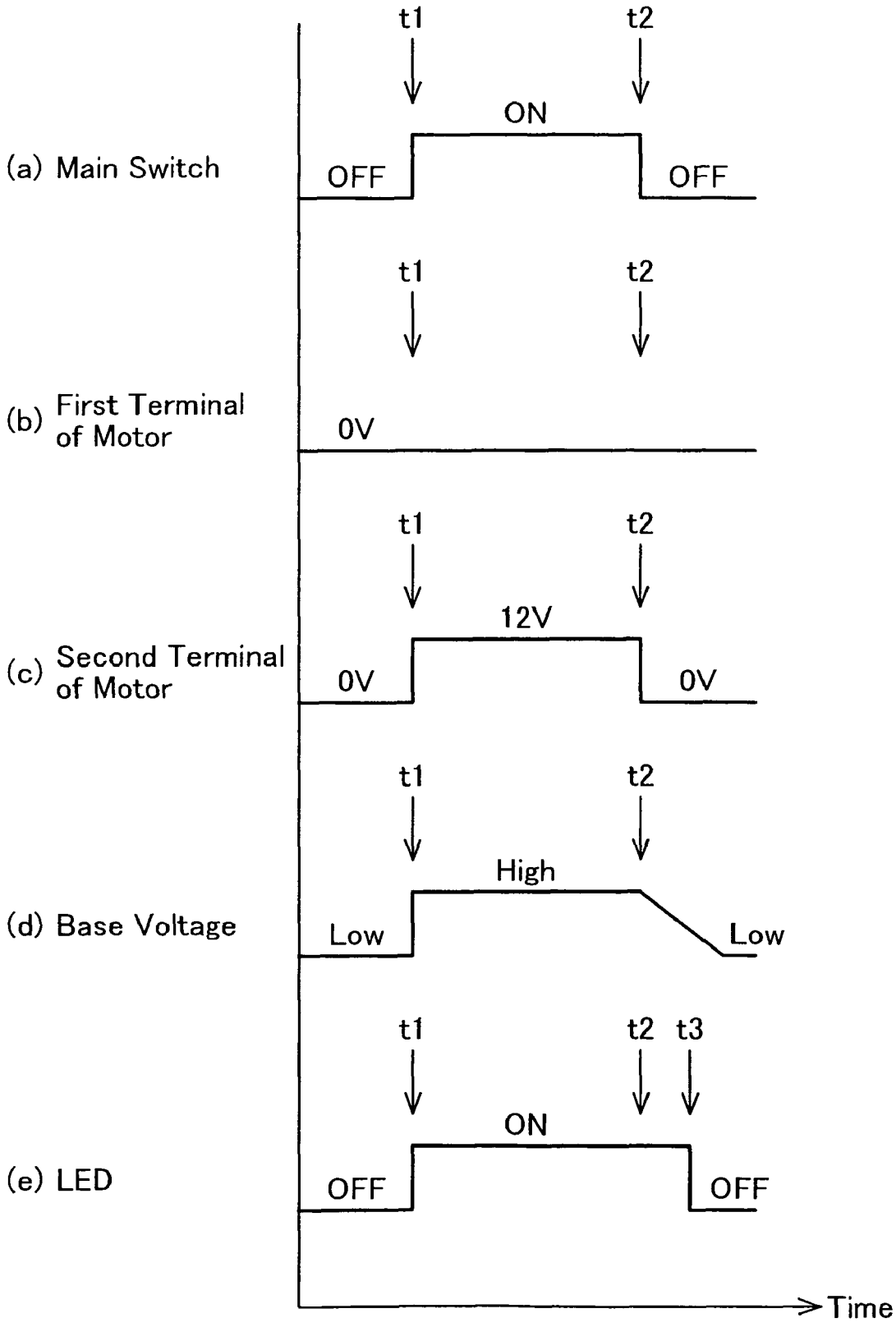
FIG. 4 shows a timing diagram describing operation and condition of principal configuration in reverse rotation.

With reference to FIG. 3 and FIG. 4, operation of the electric power driver 10 is described. FIG. 3 shows a timing diagram describing operation and condition of each unit when the electric power driver 10 is rotated in forward direction. FIG. 4 shows a timing diagram describing operation and condition of each unit when the electric power driver 10 is rotated in reverse direction. The diagrams (a) in FIGS. 3 and 4 show ON/OFF state of the main switching circuit 76. The diagrams (b) in FIGS. 3 and 4 show the electric potential of the first motor terminal 62*a*. The diagrams (c) in FIGS. 3 and 4 show the electric potential of the second motor terminal 62*b*. The diagrams (d) in FIGS. 3 and 4 show the base voltage of the transistor 46. The diagrams (e) in FIGS. 3 and 4 show the operation state (of light being turned ON/turned OFF) of the light-emitting diode 44.

With reference to FIG. 3, the case under circumstances, where the user operates the forward-reverse switching button 26 to the forward rotating direction, and the forward-reverse switching circuit 78 is switched to one direction (the state of FIG. 2) is described. In this case, the main switching circuit 76 makes or breaks the electrical connection between the first input terminal 71 and the first output terminal 72. Moreover, the second input terminal 74 is electrically connected to the second output terminal 73.

Time t1 shows a timing at which the trigger switch 28 is turned ON by the user. At this point, the main switching circuit 76 is switched to ON state, and the electrical connection between the first motor terminal 62*a* and the positive electrode 32*a* of the secondary battery 32 is established. Accordingly, the motor 62 rotates in one direction, and the tool chuck 22 performs forward rotation. At this point, the base terminal 46*b* of the transistor 46 is electrically connected to the first motor terminal 62*a* via the first diode 56, and electrically cut off from the second motor terminal 62*b* by the second diode 60. As a result, the base voltage of the transistor 46 rises (e.g. to the 'High' level), the transistor 46 becomes ON state and the light-emitting diode 44 turns ON. Specifically, light of the light-emitting diode 44 is turned ON in conjunction with ON operation to the trigger switch 28. At this point, the electrolytic capacitor 52 stores charge.

Time t2 after t1 has elapsed shows a timing at which the trigger switch 28 is turned OFF by the user's operation. At this point, the main switching circuit 76 is switched to the OFF state, and the electrical connection between the first motor terminal 62*a* and the positive electrode 32*a* of the secondary battery 32 is broken. The motor 62 and the tool chuck 22 are thereby stopped. However, the base voltage of the transistor 46 is maintained at or above the threshold voltage for a predetermined period of time even after that timing t2 by the charge stored in the electrolytic capacitor 52. As a result, the transistor 46 maintains ON state to Time t3, which is after Time t2 by a predetermined period. Thus, light of the light-emitting diode 44 is turned ON until Time t3. In other words, light of the light-emitting diode 44 is maintained for a predetermined period even after OFF operation is performed to the trigger switch 28 (i.e. afterglow function).

With reference to FIG. 4, the case where the forward-reverse switching button 26 is switched to the reverse rotating direction by user's operation, and thereby the forward-reverse switching circuit 78 is switched to the other direction is described. In this case, the main switching circuit 76 makes/breaks the electrical connection between the first input terminal 71 and the second output terminal 73. On the other hand, the second input terminal 74 is electrically connected to the first output terminal 72.

Time t1 shows a timing at which the trigger switch 28 is turned ON by the user's operation. At this point, the main switching circuit 76 is switched to ON state, and the electrical connection between the second motor terminal 62*b* and the positive electrode 32*a* of the secondary battery 32 is established. Thus, the motor 62 rotates in the other direction, and thereby the tool chuck 22 performs reverse rotation. At this point, an electrical connection between the base terminal 46*b* of the transistor 46 and the second motor terminal 62*b* is made via the second diode 60. On the other hand, an electrical connection between the base terminal 46*b* of the transistor 46 and the first motor terminal 62*a* is broken by the first diode 56. As a result, the base voltage of the transistor 46 rises (e.g. to the 'High' level), the transistor 46 is turned to ON state, and light of the light-emitting diode 44 is turned ON. In the other words, the light-emitting diode 44 is turned ON in conjunction with ON operation to the trigger switch 28 even during reverse rotation. At this point, charge is stored in the electrolytic capacitor 52.

After that, Time t2 shows a timing at which the trigger switch 28 is turned OFF by the user's operation. At this point, the main switching circuit 76 is switched to OFF state, the electrical connection between the second motor terminal 62*b* and the positive electrode 32*a* of the secondary battery 32 is cancelled. Thus, the motor 62 and the tool chuck 22 are thereby stopped. However, the base voltage of the transistor 46 is maintained at or above the threshold voltage for a predetermined period even after that timing by the electric power stored in the electrolytic capacitor 52. As a result, the transistor 46 maintains ON state until Time t3 after Time t2 by a predetermined period. Thus, light of the light-emitting diode 44 is turned ON until Time t3. In other words, light of the light-emitting diode 44 is turned ON for a predetermined period even after the trigger switch 28 is turned OFF by the user's operation.

As described above, according to the electric power driver 10 of this embodiment, it is possible to cause the light-emitting diode 44 of the light-emitting part 24 to turn ON in conjunction with ON operation to the trigger switch 28 regardless of a rotating direction (i.e. forward rotation or reverse rotation). Further, it is possible to cause the light-emitting diode 44 to turn OFF after a predetermined period from OFF operation to the trigger switch 28, regardless of a rotating direction (forward rotation/reverse rotation).

The electric power driver 10 of this embodiment adopts the switching module 70 having the main switching circuit 76 and the forward-reverse switching circuit 78 built therein. This switching module 70 enables simplification of internal wirings and miniaturization of the electric power driver 10. However, this switching module 70 may make the adopting of conventional illumination circuits impossible, since the signal line which detects ON/OFF state of the main switching circuit 76 cannot be led out from the main switching circuit 76. With consideration given to such incapability, the electric power driver 10 of this embodiment has the configuration that the first motor terminal 62*a* and the second motor terminal 62*b* are connected to the illumination circuit 40 in order to detect starting/stopping rotation of the motor 62. Moreover, the electric power driver 10 of this embodiment is configured in order that the rotating direction of the motor 62 can be switched. Accordingly, between the first motor terminal 62*a* and the second motor terminal 62*b*, the terminal to be connected to the positive electrode 32*a* of the secondary battery 32 are not fixed. Furthermore, in the illumination circuit 40 of this embodiment, the first diode 56 and the second diode 60 are provided respectively, between the first motor terminal 62*a* and the base terminal 46*b* of the transistor 46 and between the second motor terminal 62*b* and the base terminal 46*b* of the transistor 46. According to this constitution, whichever terminal of the first motor terminal 62*a* or the second motor terminal 62*b* is connected to the positive electrode 32*a* of the secondary battery 32, light of the light-emitting diode 44 is turned ON.

The specific embodiment of the present invention is described above, but this merely illustrates some possibilities of the invention and does not restrict the claims thereof. The art set forth in the claims includes variations and modifications of the specific examples set forth above.

For example, in the case where the afterglow function is not required, the electrolytic capacitor 52 may be removed from the illumination circuit 40 described in this embodiment.

The technical elements disclosed in the specification or the drawings may be utilized separately or in all types of combinations, and are not limited to the combinations set forth in the claims at the time of filing of the application. Furthermore, the art disclosed herein may be utilized to simultaneously achieve a plurality of aims or to achieve one of these aims.

What is claimed is:

1. An electric power tool comprising:

a motor that drives a tool and has a first motor terminal and a second motor terminal;

a power source unit that applies voltage to the motor terminals;

a main switching circuit that makes and breaks an electrical connection between the motor terminals and the power source unit;

an illuminator that illuminates a work spot;

a switching device that has a base terminal, wherein the switching device electrically connects the illuminator to the power source unit when voltage applied to the base terminal is higher than a threshold level;

an OR circuit that is connected to the motor terminals and the base terminal, wherein the OR circuit electrically connects to the base terminal one of the motor terminals at which the voltage is higher; and a forward-reverse switching circuit, wherein the power source unit applies DC voltage to the motor terminals via the main switching circuit, and the forward-reverse switching circuit can switch the direction of the DC voltage that is applied from the power source unit to the motor terminals, wherein the OR circuit comprises:

a first rectifying device that allows current flowing from the first motor terminal to the base terminal and forbids current flowing from the base terminal to the first motor terminal; and a second rectifying device that allows current flowing from the second motor terminal to the base terminal and forbids current flowing from the base terminal to the second motor terminal.

2. An electric power tool as set forth in claim 1, wherein:

the first rectifying device comprises a first diode, wherein an anode of the first diode is electrically connected to the first motor terminal, and a cathode of the first diode is electrically connected to the base terminal of the switching device; and the second rectifying device comprises a second diode, wherein an anode of the second diode is electrically connected to the second motor terminal, and a cathode of the second diode is electrically connected to the base terminal of the switching device.

3. An electric power tool as set forth in claim 2, further comprising a capacitor that is electrically connected to the base terminal of the switching device.

4. An electric power tool comprising:

a motor that drives a tool and has a first motor terminal and a second motor terminal;

a power source unit that applies voltage to the motor terminals;

a main switching circuit that makes and breaks an electrical connection between the motor terminals and the power source unit;

an illuminator that illuminates a work spot;

a switching device that has a base terminal, wherein the switching device electrically connects the illuminator to the power source unit when voltage applied to the base terminal is higher than a threshold level; and an OR circuit that is connected to the motor terminals and the base terminal, wherein the OR circuit electrically connects to the base terminal one of the motor terminals at which the voltage is higher, wherein the OR circuit comprises:

a first rectifying device that allows current flowing from the first motor terminal to the base terminal and forbids current flowing from the base terminal to the first motor terminal; and a second rectifying device that allows current flowing from the second motor terminal to the base terminal and forbids current flowing from the base terminal to the second motor terminal.

5. An electric power tool as set forth in claim 4, wherein:

the first rectifying device comprises a first diode, wherein an anode of the first diode is electrically connected to the first motor terminal, and a cathode of the first diode is electrically connected to the base terminal of the switching device; and the second rectifying device comprises a second diode, wherein an anode of the second diode is electrically connected to the second motor terminal, and a cathode of the second diode is electrically connected to the base terminal of the switching device.

6. An electric power tool as set forth in claim 5, further comprising a capacitor that is electrically connected to the base terminal of the switching device.

7. An electric power tool comprising:

a motor that drives a tool and has a first motor terminal and a second motor terminal;

a power source unit that applies voltage to the motor terminals;

a main switching circuit that makes and breaks an electrical connection between the motor terminals and the power source unit;

an illuminator that illuminates a work spot;

a switching device that has a base terminal wherein the switching device electrically connects the illuminator to the power source unit when voltage applied to the base terminal is higher than a threshold level; and an OR circuit that is connected to the motor terminals and the base terminal, wherein the OR circuit electrically connects to the base terminal one of the motor terminals at which the voltage is higher, wherein the OR circuit comprises:

a first diode, wherein an anode of the first diode is electrically connected to the first motor terminal, and a cathode of the first diode is electrically connected to the base terminal of the switching device; and a second diode, wherein an anode of the second diode is electrically connected to the second motor terminal, and a cathode of the second diode is electrically connected to the base terminal of the switching device.

8. An electric power tool as set forth in claim 7, further comprising a capacitor that is electrically connected to the base terminal of the switching device.

* * * * *